US011438970B2

(12) United States Patent
Zimmerman et al.

(10) Patent No.: US 11,438,970 B2
(45) Date of Patent: Sep. 6, 2022

(54) DEVICES FOR HEATING SMALL-DIAMETER TUBING AND METHODS OF MAKING AND USING

(71) Applicant: Purdue Research Foundation, West Lafayette, IN (US)

(72) Inventors: James Robert Zimmerman, Oxford, IN (US); Ryan Tyler Hilger, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 288 days.

(21) Appl. No.: 16/480,782

(22) PCT Filed: Jan. 22, 2018

(86) PCT No.: PCT/US2018/014649
§ 371 (c)(1),
(2) Date: Jul. 25, 2019

(87) PCT Pub. No.: WO2018/140344
PCT Pub. Date: Aug. 2, 2018

(65) Prior Publication Data

US 2020/0196393 A1 Jun. 18, 2020

Related U.S. Application Data

(60) Provisional application No. 62/451,128, filed on Jan. 27, 2017.

(51) Int. Cl.
*H05B 3/14* (2006.01)
*H05B 3/03* (2006.01)
(Continued)

(52) U.S. Cl.
CPC ..... *H05B 3/145* (2013.01); *H05B 3/03* (2013.01); *H05B 3/18* (2013.01); *H05B 3/58* (2013.01);
(Continued)

(58) Field of Classification Search
CPC . H05B 3/145; H05B 3/03; H05B 3/18; H05B 3/58; H05B 2203/017; H05B 2203/021
See application file for complete search history.

(56) References Cited

U.S. PATENT DOCUMENTS 4,581,521 A * 4/1986 Grise ..... H05B 3/58 219/535
4,650,964 A * 3/1987 Vincent ..... G01N 30/30 219/390
(Continued)

FOREIGN PATENT DOCUMENTS

CA 3021936 11/2016
DE 102009008304 4/2010
(Continued)

OTHER PUBLICATIONS

International Preliminary Report on Patentability for International Application No. PCT/US2018/014649, dated Jul. 30, 2019, (11 pages).
Supplemental European Search Report for European Patent Application No. EP 18744786, dated Sep. 16, 2020, 2 pages.
Canadian Examiner's Report, Canadian Application No. 3,051,842, dated Jul. 9, 2021, (4 pages).

*Primary Examiner* — Shawntina T Fuqua
(74) *Attorney, Agent, or Firm* — Hartman Global IP Law; Gary M. Hartman; Domenica N. S. Hartman

(57) ABSTRACT

Heating devices, systems, and methods of making and using a heating device. Such a heating device includes a tubular body having a passage therethrough, at least an inner layer surrounding the passage, and an outer layer surrounding the inner layer. The inner layer is electrically resistive and the outer layer is electrically insulating, and the passage is sized
(Continued)

and configured to receive therethrough a tubing. The heating device further includes electrical contacts located at oppositely-disposed ends of the tubular body. The contacts are configured to functionally couple with a power source to provide an electrical current to the inner layer, such that applying an electrical current to the inner layer increases the temperature of the inner layer.

15 Claims, 5 Drawing Sheets

(51) Int. Cl.
*H05B 3/18* (2006.01)
*H05B 3/58* (2006.01)

(52) U.S. Cl.
CPC .. *H05B 2203/017* (2013.01); *H05B 2203/021* (2013.01)

(56) References Cited

U.S. PATENT DOCUMENTS

| | | | | |
|---|---|---|---|---|
| 5,245,161 | A * | 9/1993 | Okamoto | H05B 3/56 219/535 |
| 9,538,581 | B2 * | 1/2017 | Naylor | H05B 3/56 |
| 2003/0189037 | A1 | 10/2003 | Kochman et al. | |
| 2011/0155718 | A1 * | 6/2011 | Greim | H05B 3/0019 219/539 |

FOREIGN PATENT DOCUMENTS

| | | |
|---|---|---|
| EP | 2 139 295 | 12/2009 |
| EP | 2987624 | 2/2016 |

* cited by examiner

DEVICES FOR HEATING SMALL-DIAMETER TUBING AND METHODS OF MAKING AND USING

CROSS REFERENCE TO RELATED APPLICATIONS

This application claims the benefit of U.S. Provisional Application No. 62/451,128, filed Jan. 27, 2017, the contents of which are incorporated herein by reference.

STATEMENT REGARDING FEDERALLY SPONSORED RESEARCH

This invention was made with government support under Contract No. W911NF-16-2-0020 awarded by the Defense Advanced Research Projects Agency (DARPA). The government has certain rights in the invention.

BACKGROUND OF THE INVENTION

The present invention generally relates to systems and methods for heating tubing. The invention particularly relates to heating devices configured to provide heat to small-diameter tubing products.

Various applications use flexible polymeric tubing to convey fluids. In certain applications, such tubing may or must be heated for the purpose of heating a fluid (liquid or gas) being conducted through the tubing. One approach for heating flexible polymeric tubing involves surrounding the tubing with a tape or cable comprising an encased electrical wire that produces heat when an electrical current is conducted through the wire. Another approach involves the use of an electrically resistive wire, for example, formed of NICHROME® (60Ni-24Fe-16Cr-0.1C), that is directly wrapped on the tubing. However, such methods may be impractical or ill-suited if the polymeric tubing has a particularly small diameter and/or the tape or cable interferes with the desired flexibility of the tubing. As nonlimiting examples, equipment used in low volume processes or analysis techniques, including but not limited to microfluidics, mass spectrometry (e.g., electrospray ionization (ESI)), liquid chromatography (LC), continuous flow chemical reactors, and atmospheric sampling equipment, often use small-diameter flexible tubes (for example, PTFE tubes with diameters of about 0.0625 inch (about 1.6 mm) or about 0.03125 inch (about 0.8 mm) that ideally remain flexible while installed.

In view of the above, it can be appreciated that there is an ongoing desire for systems and methods for heating tubing, including but not limited to small-diameter flexible tubing.

BRIEF DESCRIPTION OF THE INVENTION

The present invention provides devices and methods suitable for heating tubing, and particularly small-diameter flexible tubing.

According to one aspect of the invention, a heating device is provided that includes a tubular body having a passage therethrough, at least an inner layer surrounding the passage, and an outer layer surrounding the inner layer. The inner layer is electrically resistive and the outer layer is electrically insulating, and the passage is sized and configured to receive therethrough a tubing. The heating device further includes electrical contacts located at oppositely-disposed ends of the tubular body. The contacts are configured to functionally couple with a power source to provide an electrical current to the inner layer, such that applying an electrical current to the inner layer increases the temperature of the inner layer.

According to other aspects of the invention, methods are provided for using and fabricating a heating device of a type described above.

Technical effects of devices and methods as described above preferably include the capability of heating and/or regulating the temperature of small-diameter tubing that has been placed within the passage of the device.

Other aspects and advantages of this invention will be further appreciated from the following detailed description.

DETAILED DESCRIPTION OF THE INVENTION

The present disclosure provides systems, devices, and methods suitable for heating lengths of tubing, and particularly flexible, small-diameter tubing. FIGS. 1-12 disclose nonlimiting aspects of a heating device 10 capable of providing heat to at least a portion of a length of tubing (also referred to as a tube). Such a device 10 may be used in a variety of applications and can be particularly beneficial for applications that require a small-diameter tubing, for example, about 0.5 inch (about 13 mm) or less and particularly about 0.0625 inch (about 1.6 mm) or less, and/or require the tubing to be relatively flexible. Nonlimiting examples include tubing used in equipment for low volume processes or analysis techniques, including but not limited to microfluidics, mass spectrometry (e.g., electrospray ionization (ESI)), liquid chromatography (LC), continuous flow chemical reactors, and atmospheric sampling equipment. The heating device 10 may be removable as a unit from a length of tubing or may be manufactured as or become an integral component of a tubing product.

Figure 1:
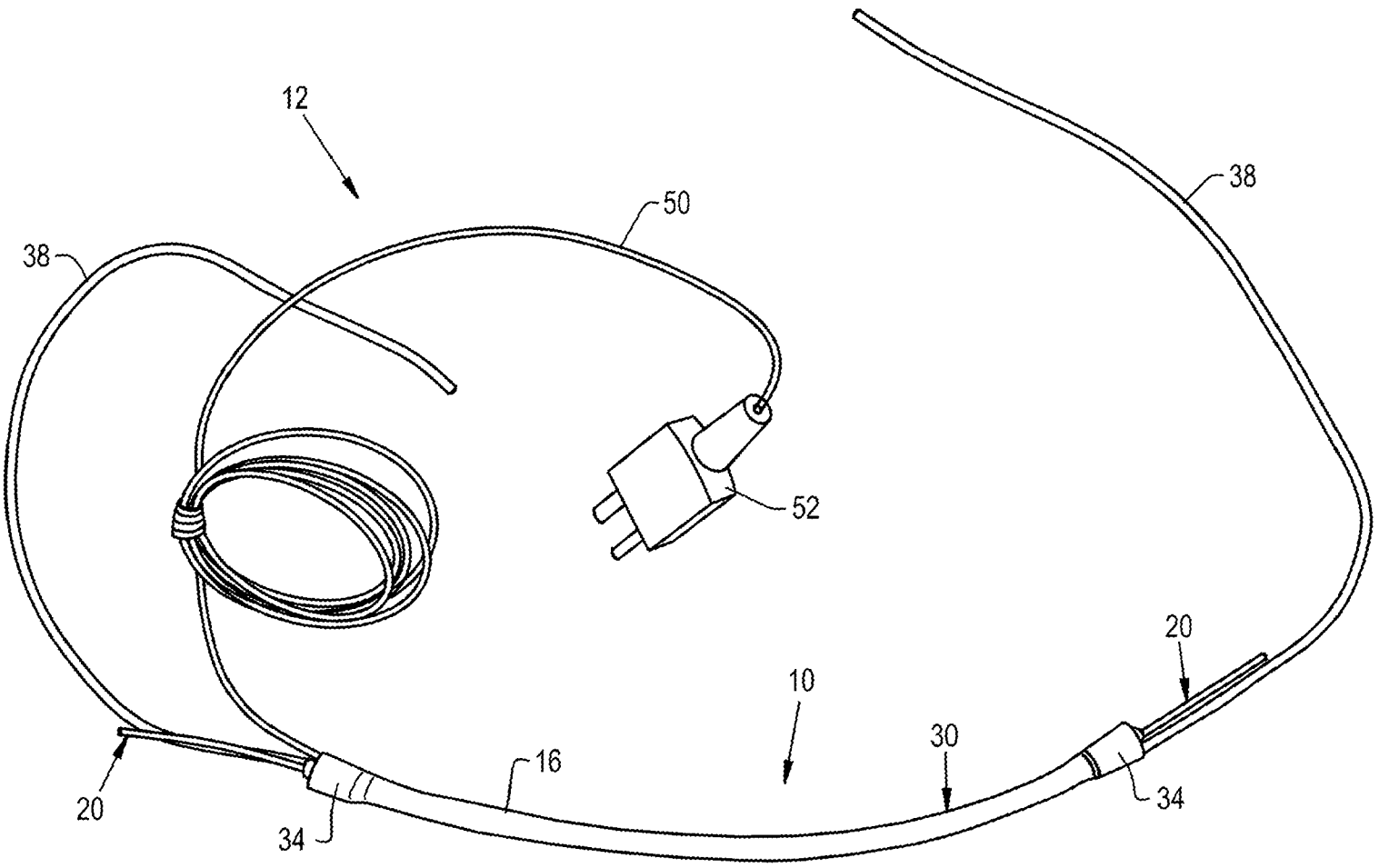
FIG. 1 represents a nonlimiting embodiment of a system that comprises a heating device in accordance with certain aspects of the invention.
Figure 2:
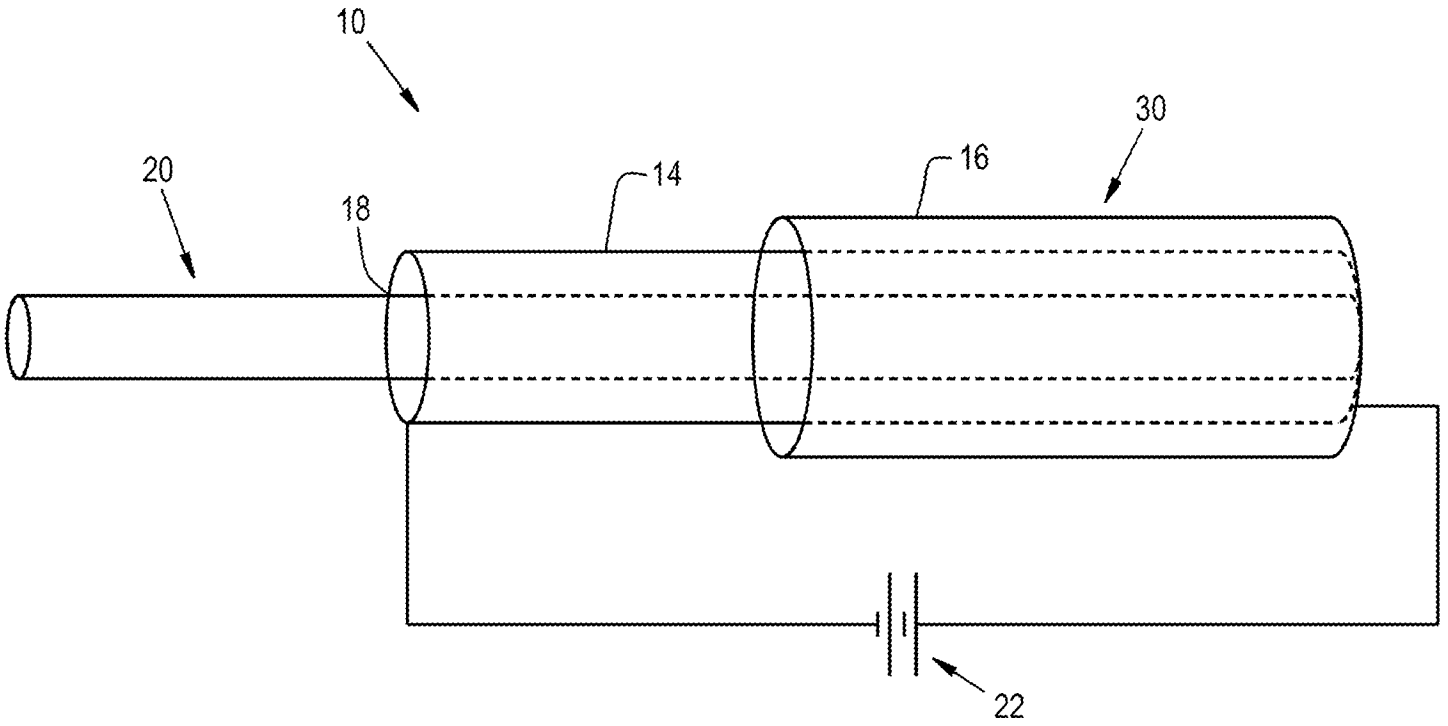
FIG. 2 schematically represents a portion of the heating device of FIG. 1.

FIG. 1 represents the heating device 10 as part of a system 12 for heating a length of flexible small-diameter tubing 20. In addition to the heating device 10, the system 12 is represented in FIG. 1 as including an electrical cord 50 and plug 52 of a temperature sensor 40 (FIG. 10) embedded within the device 10 and contact leads 38 for delivering electrical current to the device 10. FIG. 2 schematically represents a nonlimiting construction for the heating device 10 of FIG. 1, in which the device 10 is depicted as comprising an inner layer 14 formed of an electrically resistive material, which is surrounded by an outer layer 16 formed of an electrically insulating material. Together, the inner and outer layers 14 and 16 form a hollow tubular body 30 of the heating device 10. As discussed in more detail below, the inner layer 14 is preferably fabricated from a braided carbon fiber material, for example, a braided carbon fiber sleeve 32 shown in FIGS. 3 through 10, though the use of other electrically resistive materials is foreseeable, for example, semiconductive silicone tubing. Suitable materials for the outer layer 16 include, but are not limited to, a heat-shrinkable sheath formed of rubber or polytetrafluoroethylene (PTFE). It is foreseeable and within the scope of the invention that the body 30 of the heating device 10 may comprise additional layers. For example, the body 30 may include one or more additional layers to electrically insulate the inner layer 14 from other components of the heating device 10 or the tubing 20.

The device 10 defines an internal passage 18 in which the tubing 20 of FIG. 1 is received. The passage 18 is preferably sufficiently large to allow the tubing 20 to be selectively inserted and removed therefrom, so that the device 10 can be repeatedly used with different tubings or in different equipment. In the particular embodiment shown in FIG. 2, the tubing 20 is formed of a polymeric material that is electrically nonconducting, and therefore the inner layer 14 of the device 10 can be in direct contact with the tubing 10. If the tubing 20 were to be formed of an electrically conductive material (e.g., brass, steel, etc.), the device 10 may include an electrically insulating layer (not shown) to be located between the tubing 20 and the inner layer 14 to electrically insulate the tubing 20 from electricity being conducted through the inner layer 14. As a nonlimiting example, an additional insulating layer may be formed of PTFE. Alternatively, an electrically conductive tubing 20 may be manufactured to incorporate an electrically insulating layer on its outer surface, for example, the tubing 20 may be covered with a heat shrinkable sheath formed of PTFE.

In use, the device 10 is heated by Joule heating by applying an electrical current to the inner layer 14 to generate heat, which in turn can be used to regulate the temperature of the tubing 20 to an elevated temperature above ambient. FIG. 1 further represents the device 10 as comprising electrically conductive collars 34 secured at opposite ends of its tubular body 30. The collars 34 function as electrical contacts for the electrically-resistive inner layer 14, and are configured to be connected to an electrical power source (not shown) via the contact leads 38. Alternatively, either or both collars 34 may be configured for connection to additional connectors or a barrier strip (not shown). The temperature sensor 40 (FIG. 10) is embedded within the body 30, for example, between the inner and outer layers 14 and 16, to sense the temperature of the inner layer 14 during the operation of the device 10 to enable the temperature of the layer 14, and therefore the tubing 20, to be regulated. The temperature sensor 40 may be functionally connected to a suitable measuring device (not shown) via the electrical cord 50 and plug 52 or any other suitable means.

Figure 4:
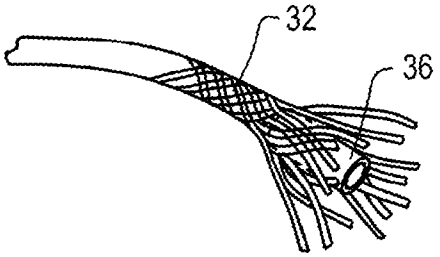
FIGS. 3 through 12 represent the system and heating device of FIG. 1 in various stages of construction.
Figure 3:
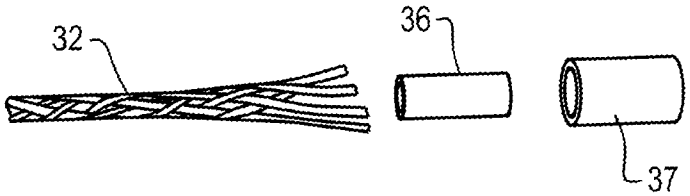
Figure 5:
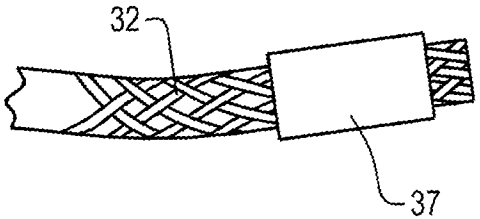
Figure 8:
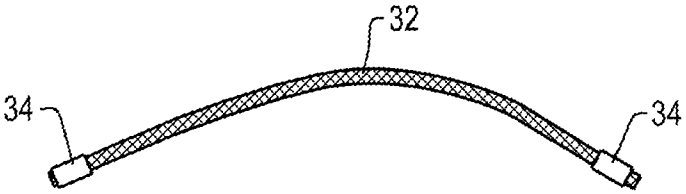

FIGS. 3 through 12 represent the heating device 10 and system 12 of FIG. 1 in various stages of construction. According to a nonlimiting method of producing the heating device 10 of FIG. 1, an electrically resistive material for the inner layer 14, represented as the aforementioned braided carbon fiber sleeve 32, may be cut to a predetermined length. FIG. 3 represents one end of the fiber sleeve 32 and two metallic tubes 36 and 37, which together will form one of the collars 34. The diameters of the tubes 36 and 37 are different and sized such that the smaller tube 36 fits within the larger tube 37. The smaller tube 36 is also sized to be inserted within the fiber sleeve 32 (inner layer 14) as represented in FIG. 4. The larger tube 37 is then positioned over the fiber sleeve 32 and tube 36, such that the end of the fiber sleeve 32 is sandwiched between the smaller and larger tubes 36 and 37, as represented in FIG. 5.

Figure 6:
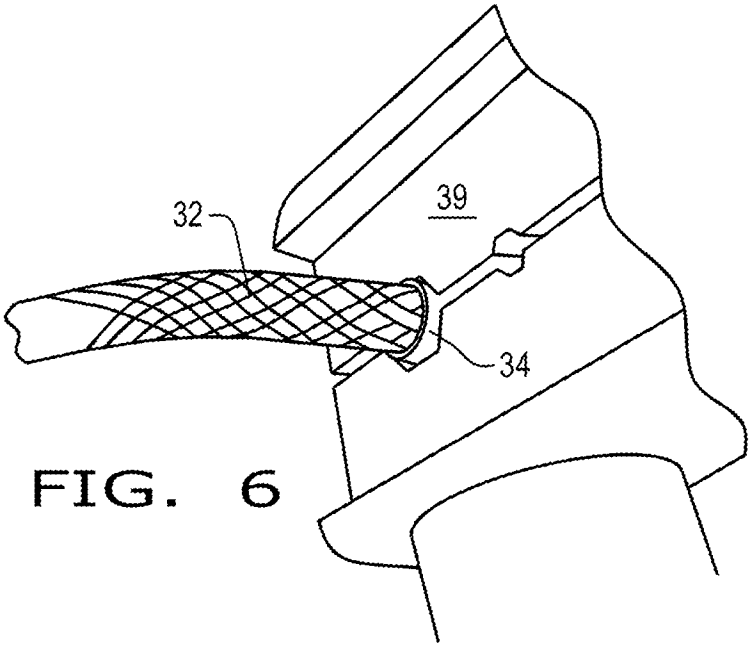
Figure 7:
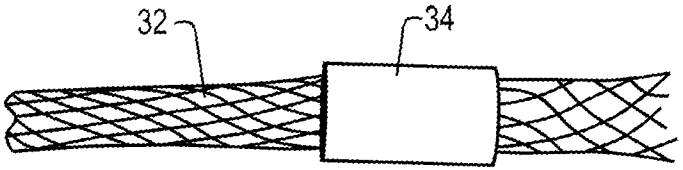
Figure 9:
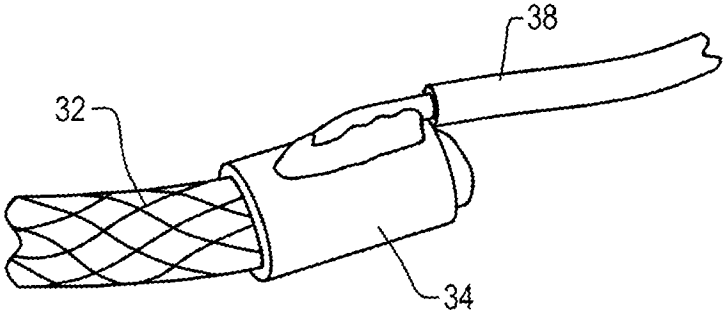

FIG. 6 depicts the use of a crimping tool 39 with an appropriate die to crimp the larger tube 37 onto the smaller tube 36 at each end of the fiber sleeve 32, producing a crimped connection and that creates one of the collars 34. If excess fibers of the fiber sleeve 32 protrude from a collar 34 as represented in FIG. 7, the excess fibers may be trimmed from the end of the collar 34, as evident from FIGS. 8 and 9. FIG. 9 represents an electrical wire (or functionally equivalent component) coupled to one of the collars 34 to define one of the contact leads 38 of FIG. 1. In the particular example of FIG. 9, an electrical wire is shown soldered to one of the collars 34.

Figure 10:
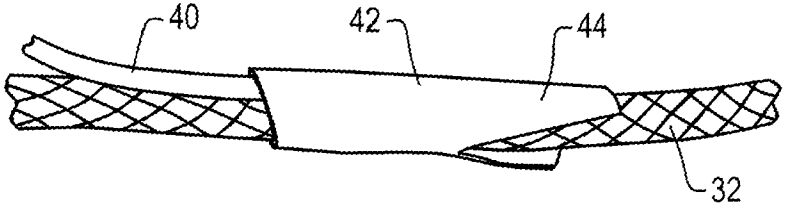

The temperature sensor 40, for example, a thermocouple (e.g., Type-J), resistance temperature detector (RTD), or thermistor, is preferably attached to the fiber sleeve 32 at a suitable location along the length of the fiber sleeve 32 between the two collars 34, preferably approximately midway along the length of the fiber sleeve 32. To electrically isolate the temperature sensor 40 from the fiber sleeve 32, an insulator may be provided between the temperature sensor 40 and sleeve 32. For example, FIG. 10 represents a junction tip 42 of a thermocouple located between layers of an electrically insulating tape 44 (e.g., a polyimide film tape) that has been wrapped around the fiber sleeve 32, so that the junction tip 42 is secured to and electrically insulated from the sleeve 32.

Figure 12:
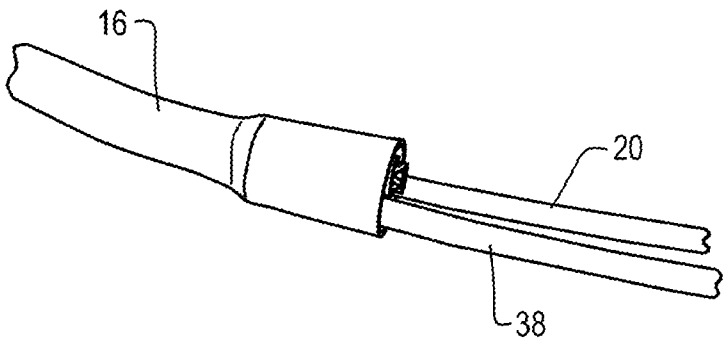
Figure 11:
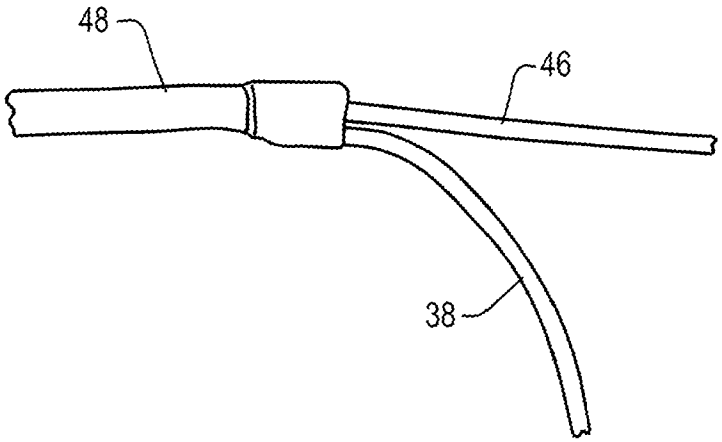

In FIG. 11, the fiber sleeve 32 is entirely within an electrically insulating sheath 48 and a length of solid wire 46 is shown inserted and routed entirely through the internal passage 18 of the fiber sleeve 32. The wire 46 is used as a temporary form (hereinafter, forming wire 46) and is preferably placed within the passage 18 to prevent the fiber sleeve 32 from collapsing as the sheath 48 is installed onto the fiber sleeve 32 to form the outer layer 16. Once the forming wire 46 has been inserted, the sheath 48 may be cut to length and slid over the fiber sleeve 32, preferably fully covering the collars 34 as shown in FIG. 11. In the case of the outer layer 16 being formed of a heat-shrinkable material, the sheath 48 can be heated to cause the sheath 48 to shrink, so that the resulting outer layer 16 tightly fits around the fiber sleeve 32. Thereafter, the forming wire 46 is removed from the sleeve passage 18, whose shape and size can be either maintained by or defined by the forming wire 46 so that the resulting heating device 10 is configured to receive the tubing 20 as shown in FIG. 12. For this purpose, the tubing 20 must have a predetermined diameter or a diameter within a predetermined range of diameters (for example, equal to or smaller than the diameter of the forming wire 46).

Alternatively, in some cases the heating device 10 may be manufactured as or become an integral component of the tubing 20. For example, the tubing 20 could be inserted and routed through the internal passage 18 of the inner layer 14 in place of a forming wire 46, and thereafter used as a form that prevents the inner layer 14 from collapsing as the sheath 48 is installed onto the inner layer 14 to form the outer layer 16. In these cases, the heating device 10 is formed around the tubing 20 and as such is an integral component of the tubing 20, and therefore cannot be removed or is difficult to remove from the tubing 20 without damaging the device 10 and/or tubing 20. However, a preferred aspect of the invention is to provide a heating device 10 that enables the device 10 or tubing 20 to be readily removed and replaced without damage to either, in which case the heating device 10 is fabricated using the forming wire 46 (or other suitably sized and shaped forming tool) and is not an integral component of the tubing 20.

During use of the heating device 10, an electric current is applied to the contact leads 38 from the power source 22 (FIG. 2), preferably a direct current (DC) power supply operating in a constant current mode, thereby dissipating power and Joule heating the electrically-resistive inner layer 14 and the tubing 20 within the device 10. Preferably, compliance voltage is determined prior to use. The power source 22 may then be activated with voltage adjustment set to the determined compliance (maximum) voltage. The temperature of the device 10 may be monitored and/or regulated with feedback provided by the temperature sensor 40.

Given a desired temperature and a predetermined constant electrical resistance per length of the inner layer 14, for example, ohms per inch, the compliance or maximum voltage can be determined for a given application. For example, a 0.25 inch (about 6.4 mm) diameter braided carbon fiber sleeve commercially available from Rock West Composites (Part number BR-C-025) has an average resistance of 0.17 ohms per inch. Therefore, to maintain a temperature of about 110° C. in this fiber sleeve, a current of approximately 2.0 amperes is required to flow through the sleeve. If the braided carbon fiber sleeve length is 10 inches (25.4 cm), the total resistance is 1.7 ohms. Using ohms law, the compliance voltage of the power supply is a minimum of about 3.40 volts (1.7 ohms×2.0 amps). The compliance voltage would increase as the braided carbon fiber sleeve length (and resistance) increases. The same calculation may be used if multiple heating devices 10 are connected in series. Since resistance per unit length is a constant, multiple heating devices 10 of various different lengths can be connected in series and operated at a constant current to achieve the same temperature.

Table 1 below discloses temperatures obtained at various constant currents for the 0.25 inch (6.4 mm) diameter braided carbon fiber sleeve noted above, and Table 2 discloses maximum operating parameters for the braided carbon fiber sleeve (corresponding to the inner layer 14 of the device 10) having a heat-shrinkable rubber sheath thereon (corresponding to the outer layer 16 of the device 10).

TABLE 1

| Constant Current (A) | Temperature (° C.) |
|---|---|
| 0.5 | 32 |
| 1.0 | 50 |
| 1.5 | 77 |
| 2.0 | 110 |
| 2.5 | 140 |

TABLE 2

| | |
|---|---|
| Resistance | 0.17 ohms per inch |
| Maximum Voltage | 0.375 Volts per inch |
| Maximum Temperature | 150° C. |
| Maximum Current | 2.5 Amps |

One nonlimiting application for heating devices of the type disclosed herein includes regulating the temperature of flexible polymeric tubing used in low volume processes or analysis techniques, including but not limited to microfluidics, mass spectrometry (e.g., electrospray ionization (ESI)), liquid chromatography (LC), continuous flow chemical reactors, and atmospheric sampling equipment. In such applications, it may be necessary or desirable to heat a flexible polymeric tubing to maintain compound solubility, increase reaction rates, decrease fluid viscosity, etc., of a fluid flowing through the tubing. One particular example is 0.0625 inch (1.6 mm) and 0.03125 inch (0.8 mm) tubing formed of polyetheretherketone (PEEK) or tetrafluoroethylene (TFE), which are commonly used in liquid chromatography applications. In investigations leading to the present invention, a heating device 10 constructed with the 0.25 inch (6.4 mm) diameter braided carbon fiber sleeve noted above was fabricated to have a passage 18 of sufficient diameter to accommodate a 1.6 mm tubing. During construction, a 12-gauge (2 mm diameter) solid wire was used as the forming wire 46 during the step of shrinking a heat-shrinkable sheath 48 to ensure that an adequate diameter was maintained for the passage 18 within the heating device 10.

While the invention has been described in terms of a specific or particular embodiment and investigations, it should be apparent that alternatives could be adopted by one skilled in the art. For example, the system 12, heating device 10, and their components could differ in appearance and construction from the embodiment described herein and shown in the drawings, functions of certain components of the heating device 10 and system 12 could be performed by components of different construction but capable of a similar (though not necessarily equivalent) function, process parameters such as temperatures and durations could be modified, and appropriate materials could be substituted for those noted. Accordingly, it should be understood that the invention is not necessarily limited to any embodiment described herein or illustrated in the drawings. It should also be understood that the phraseology and terminology employed above are for the purpose of describing the disclosed embodiment and investigations, and do not necessarily serve as limitations to the scope of the invention. Therefore, the scope of the invention is to be limited only by the following claims.

The invention claimed is:

1. A heating device comprising:

a tubular body having a passage therethrough and through oppositely-disposed ends of the tubular body, the tubular body comprising at least an inner layer defining and surrounding the passage and an outer layer surrounding the inner layer, the inner layer being electrically resistive and the outer layer being electrically insulating, the passage being sized and configured to removably receive therethrough a tubing;

electrically-conductive first and second collars secured at the oppositely-disposed ends of the tubular body and functioning as electrical contacts for the inner layer, each of the first and second collars comprising a first tube received in the passage and surrounded by an end of the inner layer at one of the oppositely-disposed ends of the tubular body and a second tube surrounding the end of the inner layer and crimped onto the first tube to sandwich the end of the inner layer therebetween;

a temperature sensor coupled to the tubular body to monitor a temperature of the inner layer at a location along a length the inner layer between the first and second collars, the temperature sensor having a junction tip that is located between the inner layer and the outer layer and electrically insulated from the inner layer;

a cord connected to the temperature sensor and exiting the tubular body; and contact leads located at the oppositely-disposed ends of the tubular body, each of the contact leads being electrically connected to one of the first and second collars and configured to functionally couple with a power source to provide an electrical current to the inner layer, wherein applying an electrical current to the inner layer increases the temperature of the inner layer.

2. The heating device of claim 1, wherein the cord is embedded between the inner and outer layers of the tubular body and exits the tubular body at one of the oppositely-disposed ends of the tubular body.

3. The heating device of claim 1, wherein the inner layer is a braided carbon fiber sleeve.

4. The heating device of claim 1, wherein the outer layer is a heat-shrinkable sheath.

5. The heating device of claim 1, wherein the passage has an internal diameter of 13 millimeters or less.

6. The heating device of claim 1, further comprising the tubing removably received in the passage of the tubular body.

7. The heating device of claim 6, wherein the tubing is a flexible component of a microfluidics, mass spectrometry, liquid chromatography, continuous flow chemical reactors, and atmospheric sampling equipment.

8. A method of using the heating device of claim 1, the method comprising:

removably inserting a polymeric tubing into the passage of the tubular body;

applying an electrical current to the electrical contacts to heat the inner layer; and while the polymeric tubing is being heated by the heating device, using the polymeric tubing in an application chosen from the group consisting of microfluidics, mass spectrometry, liquid chromatography, continuous flow chemical reactors, and atmospheric sampling applications.

9. The method of claim 8, wherein the application is a liquid chromatography application.

10. The method of claim 8, wherein the application is a continuous flow chemical reactor application.

11. The method of claim 8, wherein the application is a sampling line application.

12. A method of fabricating the heating device of claim 1, the method comprising:

securing the first and second collars at oppositely-disposed ends of an electrically-resistive sleeve having an internal passage;

placing a forming wire within the internal passage of the electrically-resistive sleeve;

installing an electrically insulating sleeve over the electrically-resistive sleeve;

shrinking the electrically insulating sleeve onto the electrically-resistive sleeve, wherein the electrically-resistive sleeve serves as the inner layer of the heating device, the electrically insulating sleeve serves as the outer layer of the heating device, and together the electrically-resistive sleeve and the electrically insulating sleeve form the tubular body of the heating device, the forming wire preventing the internal passage of the electrically-resistive sleeve from collapsing during the shrinking thereof.

13. The method of claim 12, wherein the electrically-resistive sleeve is a braided carbon fiber sleeve.

14. The method of claim 12, wherein the electrically insulating sleeve is a heat-shrinkable sheath and the shrinking step comprises applying heat to the heat-shrinkable sheath.

15. The method of claim 12, wherein the passage has an internal diameter of 13 millimeters or less.

* * * * *